United States Patent [19]

Lind

[11] Patent Number: 4,609,188

[45] Date of Patent: Sep. 2, 1986

[54] DEVICE FOR DOING SITUPS

[76] Inventor: Charles F. Lind, 2210 E. Sherwood, Arlington Hts., Ill. 60004

[21] Appl. No.: 677,695

[22] Filed: Dec. 3, 1984

[51] Int. Cl.[4] ..... A63B 23/04

[52] U.S. Cl. ..... 272/93; 272/144; 272/145; 272/900

[58] Field of Search ..... 272/93, 144, 145, 900; 128/134

[56] References Cited

U.S. PATENT DOCUMENTS

| | | | |
|---|---|---|---|
| 2,050,652 | 8/1936 | Fleming | 272/93 |
| 3,188,090 | 6/1965 | Job | 128/134 |
| 3,191,599 | 6/1965 | Kendall | 128/134 |
| 3,524,643 | 8/1970 | Hazelitt, Sr. | 272/900 |
| 3,535,719 | 10/1970 | Murcott | 128/134 X |
| 3,628,790 | 12/1971 | Gordon | 272/145 X |
| 4,186,920 | 2/1980 | Fiore et al. | 272/96 |
| 4,205,670 | 6/1980 | Owens | 128/134 |
| 4,337,938 | 7/1982 | Rodriguez | 272/93 |

*Primary Examiner*—Robert A. Hafer
*Assistant Examiner*—Kathleen J. D'Arrigo

[57] ABSTRACT

A portable device adapted to be secured to a generally horizontal board, vis a bench in a locker room or the like, operable to assist an exerciser in doing situps and related exercises. The device has a single flexible board strap and a pair of flexible leg straps secured to the board strap. The board strap is of sufficient length to be wrapped around the board, extending transverse to the length thereof; and means are provided to secure the ends of the board strap together to hold the board strap firmly wrapped in place relative to the board. Each leg strap is formed of two pieces having adjacent end portions that are disposed on opposite faces of the board strap, and that are overlapped and secured together as by stitches adjacent the opposite side edges of the board strap. This secures each leg strap relative to the board strap at an orientation extended transverse to the board strap, and laterally holds the leg strap relative to the board strap, while allows each leg strap to be shifted axially along the length of the board strap into alignment on the upper side of the board with a respective leg of the exerciser. The leg straps are of sufficient length, after being twisted one-quarter of a turn, to be wrapped over an ankle or foot of the leg of the exerciser and overlapped, and means are provided to secure the overlapped ends of the leg straps together, operable to hold the foot or ankle firmly in place relative to the board.

2 Claims, 6 Drawing Figures

DEVICE FOR DOING SITUPS

BACKGROUND OF THE INVENTION

Situps are widely recognized as a very beneficial exercise for firming up the stomach and abdominal muscles, for health and cosmetic purposes, as well as for personal satisfaction.

In the situp, the exerciser lies on a supporting surface on his backside and elevates the upper body including the arms and head off the supporting surface. As the body pivots generally about the buttock which remains against the supporting surface, the natural tendency is for the feet to lift up, somewhat at least, off the floor. The exercise can be performed much more rapidly and more beneficially if someone, or a device of some type, holds the feet firmly in place relative to the supporting surface. This also allows for doing situps with weights carried by the exerciser to even further increase the force needed to lift the upper body off the supporting surface.

Exercise clubs frequently have situp boards for holding the feet down to assist one in doing situp exercises. One type board uses a well padded bar located some 6 to 8 inches off the supporting board surface which allows the user to lock his feet and/or ankle under the supporting bar. Another device uses a flexible strap that can be put over the foot and ankle area. However, most people do not belong or have access to that type club, or otherwise do not have such equipment for home use.

SUMMARY OF THE INVENTION

This invention relates to a device to assist one in doing situps by holding the exerciser's feet firmly relative to the supporting surface.

A specific object of this invention is to provide a device that can be used to convert a suitably sized board, or typically a bench of the type found in locker rooms of work establishments, health clubs or the like, into an apparatus for performing situps, back arches, side arches or related exercises to the extent that the feet or leg area of the exerciser can be securely and firmly held in place relative to the board. This would allow weighted or rapid succession exercises for more beneficially toning up the stomach or back muscles of the user in question.

Another object of this invention is to provide a device that is easily fabricated from economical components, such as nylon or leather straps or the like, and securing means such as conventional belt clips and/or overlapping hook and loop fasteners such as marketed under the VELCRO trademark; and further which can be lightweight, compact and collapsible for easy storage and/or transporting such as in a duffel bag and/or in a locker in the exercise room itself.

Another object of this invention is to provide an exercise device that can be secured firmly to a board or bench and that will support loads comparable to the weight of the exerciser using the device, to hold the feet and ankle area of the exerciser firmly relative to the board such that situps, back arches, side lifts or related exercises can be performed on the bench, both in a conventional fashion where the upper body overlies the bench or in a cantilevered fashion where the upper body can be cantilevered beyond the end of the bench, while the device holds and prevents the exerciser from falling off the bench.

A BRIEF DESCRIPTION OF THE DRAWINGS

DETAILED DESCRIPTION OF THE INVENTION

Figure 1:
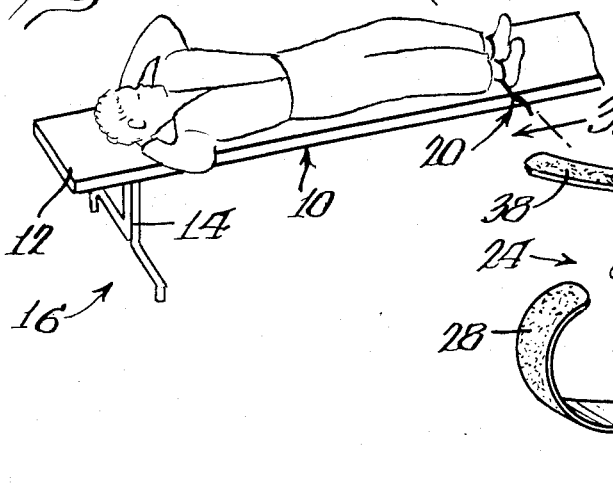
FIG. 1 is a perspective view of an exercise device shown in operative association with a typical bench and holding the feet of an exerciser firmly relative to the bench.
Figure 5:
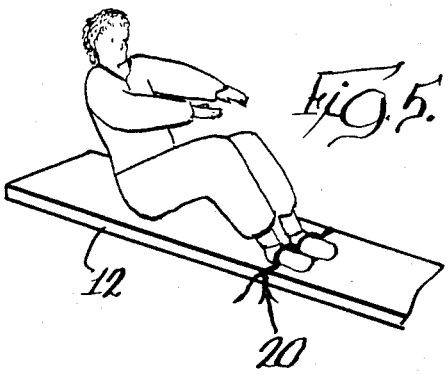
FIGS. 5 and 6 illustrates the device applied on a bench or board showing alternate forms of using the device.
Figure 6:
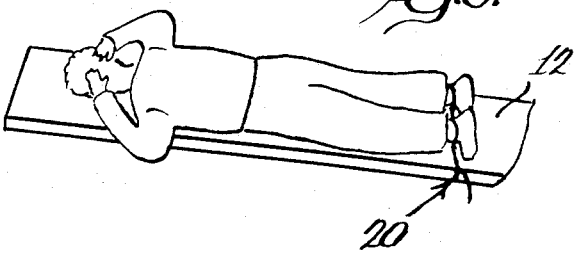

FIGS. 1, 5 and 6 illustrates a bench 10 generally having a horizontally disposed board 12 and upstanding support post or legs 14 holding the bench above a flat floor 16. This bench configuration would be typical to those found in locker rooms for factories, schools, company businesses, tennis or health clubs or the like. The bench typically is secured by bolts (not shown) to the floor so that it is permanently located in place, and generally is highly durable and capable of holding several people simultaneously sitting or moving about on the bench. In the illustrations, the subject exercise device 20 is secured relative to the bench 10 and serves to hold the feet or ankle area of an exerciser secured relative to the bench.

The device 20 is seen to include basically a strap 22 of simple elongated construction which is sized to wrap circumferentially around the cross sectional area of the support board 12 of the bench 10, and securing means 24 for holding the ends of the strap secured so that the strap 22 is held wrapped in place on the bench. In the illustration, an eyelet 26 is provided at one end of the strap, and the other end of the strap is adapted to fit through the eyelet and be backfolded on itself; and separable friction connectors preferably of hook and loop fasteners 28 and 30, such as marketed under the VELCRO trademark, are secured onto corresponding adjacent opposite portions of the strap in the region of overlap.

Figure 3:
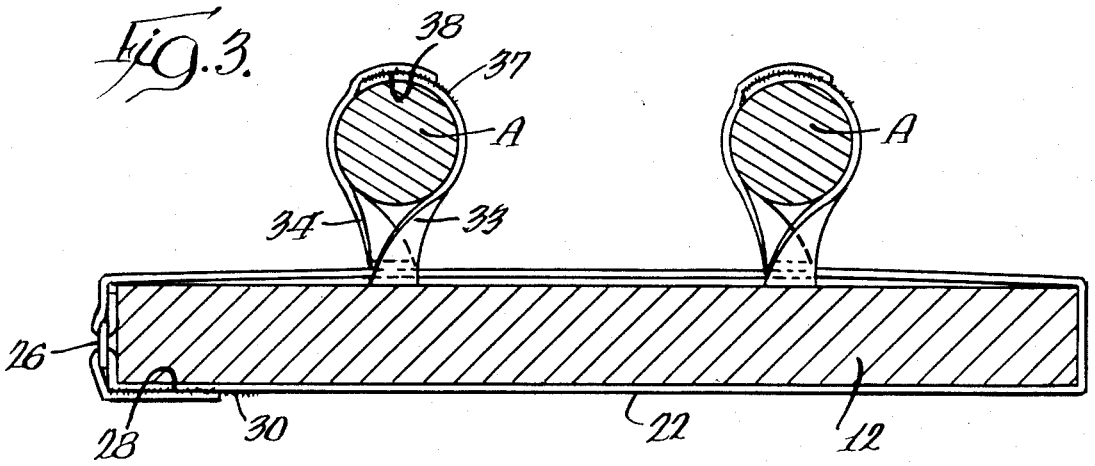
FIG. 3 is a sectional view of the device as seen generally from line 3—3 in FIG. 1, showing its securement on a bench and to the ankles of an exerciser.

Other forms of securing means (not shown) such as a conventional barbed buckle for a strap having holes; or a friction type buckle can be used to hold the lapped strap ends secured together but adjustably lengthwise of the strap so that the strap can be tightened snuggly around the board as illustrated in FIG. 3.

Figure 2:
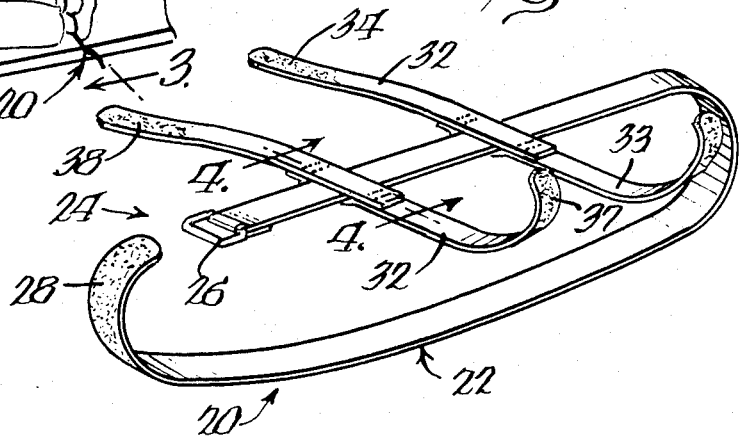
FIG. 2 is a perspective view of the exercise device in question, shown removed from the bench for clarity of disclosure.
Figure 4:
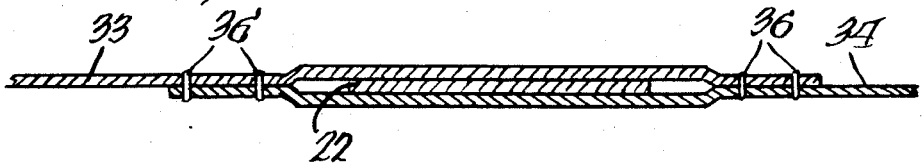
FIG. 4 is a sectional view as seen generally from line 4—4 in FIG. 2.

Also located and secured relative to the strap 22 are a pair of individual leg straps 32. The preferred embodiment of these leg straps 32 uses two separate straps 33, 34 (FIG. 4) that overlap one another and pass on opposite sides of or straddle the bench strap 22 and are held together as by stitches or the like 36. This holds the leg straps 32 relative to the bench strap 22 but also allows the leg straps to be adjusted lengthwise along the bench strap. A preferred embodiment provides that the separate straps 33, 34 have the opposite mating portions 37, 38 of a Velcro-type hook and loop fastener, so that the strap can be overlapped and firmly and quickly secured together. As illustrated in FIG. 2, the leg straps 32 cross the bench strap 22 at right angles, so that the leg straps would normally lie in line with the bench; and thus would be twisted or rotated 90° (as shown in FIG. 3) to extend crosswise to the bench so as to be secured in place around the ankles or feet of the exerciser.

As illustrated in FIGS. 1 and 3, one manner of using the exercise device 20 would be to secure the leg straps around the ankles A of the user. This would hold the heel areas of the foot firmly against the board 12 during a normal situp, with the exerciser lying on his back. Alternatively, as illustrated in FIG. 6, the exerciser can lay on his stomach and perform back-arches on the board by means of the same exercise device, where again the leg straps would be secured to the ankles of the user and the toes and/or insteps of the user's feet are held against the board. The securement of the ankles allows the exerciser to have his legs extended somewhat parallel to or in fact even lying against the bench. However, a current recommended form of situps has the legs bent with the knees lifted off the board, whereupon the exerciser's feet are held flat against the top board surface and even closely adjacent the exerciser's buttocks. The device can be secured to the ankles or over the instep of the feet (as illustrated in FIG. 5) in order to allow the exerciser to do this form of exercise.

The device could be used with the person lying on his side (not shown) to exert the side muscles at the waist.

Moreover, with the bench 10 being secured in place by means of bolts or the like, the device 20 will hold the exerciser's feet relative to the bench and allow the upper body from generally the waist portion up to be cantilevered beyond the end of the bench. This allows for even greater stretching and loading of the related muscles beyond the normal straight line body posture, such as into a back bending configuration while on his back whereupon the head might even be lowered down to touch the floor 16. Moreover, the cantilevered type situp must be done without the rolling action of the exerciser's back against the board, to the end that it is more difficult and could be more beneficial.

While emphasis has been placed to use this exercise device on a bench, in fact, the device would have great appeal for use on any flat board that might be provided by the exerciser. In this regard, an old ironing board or any other such suitably sized board that might be common around a household (and in fact ready to be discarded for want of use and/or for duplication) can be converted with this device into an apparatus on which to perform situps. In such use, the exercise device 20 would be applied to one end of the board where the exerciser would lie over the middle and opposite end of the board serving to hold the board down in place. If necessary, some means (not shown) might be used to secure the board in place, such as in home life confinement.

Moreover, towels, blankets, floor covering or padding or the like could be used on any of the boards in question in using the disclosed exercise device, for increased cushioning and comfort of the exerciser.

The straps 22 and 32 are formed of any nonelastic, flexible but strong material, such as woven nylon, leather or the like, so that the same would be of lightweight and high strength construction, and capable of being folded up for compact storage. The bench strap 22 should be sized to hold a load at least comparable to the weight of the exerciser, and might be 1 to 3 inches in width to give the feel of quality. The leg straps 32 would generally be preferably between ½ and 1 inch in width, to allow for sufficient contact area to give good user comfort. Of course, the user can directly pad up the ankle areas under the ankle straps as needed by means of towels or the like for improving sought-for comfort.

Instead of having the dissimilar hook and loop fasteners 37, 38 formed on the respective separate end pieces 33, 34 of each leg strap, an eyelet configuration similar to that used on the board strap 22 can be used as the securing means. This has the advantage of doubling the holding power of the hook-loop fasteners for the area of the same that is overlapped and secured together. Also, while not as desirable, the device would be operable using only one set of the leg straps that would be wrapped on or looped over both feet or ankles of the exerciser.

What I claim as my invention is:

1. A portable device operable to assist an exerciser in doing situps and related exercises on an elongated generally horizontal board, comprising a single board strap, and a pair of leg straps, one for each leg of an exerciser;

said straps being of strong and flexible, but nonelastic, material;

said board strap being of sufficient length to be wrapped transversely completely around the board, so as to extend crosswise to the length of the board, and to an exerciser who would be positioned, sitting or lying on the board with the legs extended in the direction of and along and over the board, for doing the exercises;

means to secure the opposite ends of the board strap together to hold the board strap wrapped in place firmly relative to the board, means to secure each of the leg straps to the board strap to confine the leg strap laterally of the board strap while allowing movement of the leg strap axially along board strap;

each leg strap being adjusted by sliding axially along the board strap, on the upper side of the board, to be laterally aligned relative to a respective one of the legs of the exerciser, and each leg strap having opposite end portions that can be twisted one-quarter of a turn and brought adjacent the opposite sides of an ankle or foot of a respective leg of the exerciser, and can be looped over the ankle or foot area of each respective leg of the exerciser, and can be overlapped on one another, and means to releasibly secure together the two overlapped end portions of each leg strap as looped in place relative to the respective ankle or foot area of the exerciser, operable to preclude the legs of the exerciser from lifting off of the board.

2. A portable exercise device to assist one in doing situps and related exercises according to claim 1, wherein further each of the leg straps is formed of two-pieces each having adjacent end portions adapted to be overlapped on one another and be disposed on opposite faces of the board strap and extended transversely to the latter, and means to secure the end portions together adjacent the opposite side edges of the board strap, to confine the leg strap laterally relative to the board strap while allowing movement of the leg strap axially along the board strap.

* * * * *